US007752975B1

(12) United States Patent
Yousef et al.

(10) Patent No.: US 7,752,975 B1
(45) Date of Patent: Jul. 13, 2010

(54) INSENSITIVE MUNITIONS BARRIER

(75) Inventors: Amin Yousef, Budd Lake, NJ (US); Khawla Yousef, legal representative, Budd Lake, NJ (US); Crane Robinson, Oxford, NJ (US); Gould Gibbons, Jr., Finksburg, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 469 days.

(21) Appl. No.: 11/689,553

(22) Filed: Mar. 22, 2007

Related U.S. Application Data

(60) Provisional application No. 60/807,833, filed on Jul. 20, 2006.

(51) Int. Cl.
*F42B 39/14* (2006.01)

(52) U.S. Cl. ..... 102/481; 102/499; 102/293; 86/47; 206/3; 206/317

(58) Field of Classification Search ..... 102/481, 102/499, 473, 293; 86/50, 47; 206/317, 206/3
See application file for complete search history.

(56) References Cited

U.S. PATENT DOCUMENTS

| | | | | | |
|---|---|---|---|---|---|
| 2,420,663 | A * | 5/1947 | Heath et al. | 220/592.01 |
| 3,757,933 | A * | 9/1973 | Banta | 206/3 |
| 4,286,708 | A * | 9/1981 | Porzel | 206/3 |
| 4,440,296 | A * | 4/1984 | Howe et al. | 206/3 |
| 4,484,678 | A * | 11/1984 | Walker et al. | 206/3 |
| 4,850,260 | A * | 7/1989 | Walker et al. | 89/34 |
| 5,022,307 | A * | 6/1991 | Gibbons et al. | 89/36.02 |
| 5,157,223 | A * | 10/1992 | Wheeler et al. | 102/374 |
| 5,158,173 | A * | 10/1992 | Halsey et al. | 206/3 |
| 5,390,580 | A * | 2/1995 | Gibbons et al. | 86/50 |
| 6,772,877 | B1 * | 8/2004 | Lam et al. | 206/3 |
| 6,865,977 | B1 * | 3/2005 | Kim et al. | 86/50 |
| 7,066,320 | B2 * | 6/2006 | Sansolo | 206/3 |
| 7,343,843 | B2 * | 3/2008 | Sharpe et al. | 86/50 |
| 7,406,909 | B2 * | 8/2008 | Shah et al. | 89/36.02 |
| 7,520,223 | B2 * | 4/2009 | Sharpe et al. | 102/303 |
| 7,546,917 | B1 * | 6/2009 | Lam et al. | 206/3 |
| 2008/0053843 | A1 * | 3/2008 | Edwards et al. | 206/3 |

OTHER PUBLICATIONS http://web.archive.org/web/20000118153007/http://fas.org/man/dod-101/sys/land/bullets2.htm Jan. 18, 2000.*

* cited by examiner

*Primary Examiner*—Michael Carone
*Assistant Examiner*—Michael D David
(74) *Attorney, Agent, or Firm*—Henry S. Goldfine

(57) ABSTRACT

A sympathetic detonation barrier for a munition includes a generally cylindrical polyethylene sleeve disposed over the munition. Preferably, the sleeve comprises HDPE. The sleeve may include vent openings in a side wall. In one embodiment, the sleeve extends from substantially a rear end of the munition to substantially a rear end of a fuze well of the munition.

4 Claims, 2 Drawing Sheets

INSENSITIVE MUNITIONS BARRIER

CROSS-REFERENCE TO RELATED APPLICATIONS

This application claims the benefit under 35 USC 119(e) of U.S. provisional patent application No. 60/807,833 filed on Jul. 20, 2006, which application is hereby incorporated by reference.

STATEMENT OF GOVERNMENT INTEREST

The inventions described herein may be manufactured, used and licensed by or for the U.S. Government for U.S. Government purposes.

BACKGROUND OF THE INVENTION

The invention relates in general to munitions and in particular to packaging for artillery ammunition that mitigates or eliminates sympathetic detonation.

Sympathetic detonation (SD) is the propagation of the detonation from one round of ammunition to adjacent rounds of ammunition when collocated in stowage or shipping configurations. SD yields substantial collateral damage including the loss of life and critical military equipment. The problem of propagation of the detonation reaction has existed since initial fielding of munitions containing high explosives. There had been no practical method to prevent SD in packaged high explosive ammunition until the development in the 1960s of anti-fratricide stowage in ammunition compartments for combat vehicles, specifically, the M1 Abrams tank. A safe separation distance and reinforced bunkers/barricades can prevent SD between high explosive ammunition, but this technique is generally applied to stored munitions in ammunition magazines that are properly sited according to their hazard classification for safe storage distances.

Known methods of mitigating or eliminating SD address the problem in stowed configurations onboard combat vehicles, but are not practical for the logistical life-cycle of munitions. An important concern is the transport of large quantities of munitions to a theater of operations. SD during transport involves large quantities of munitions, and can potentially have catastrophic consequences resulting in massive casualties, damage to military and civilian equipment and damage to surrounding infrastructure. An historic example of this occurred in Kuwait during the first Gulf war in 1991. A malfunction in a vehicle's heater resulted in a high number of casualties, with loss of life and military equipment (ammunition, vehicles, etc) as well as damage to the land and surrounding infrastructure. There is a need to eliminate the possibility of sympathetic detonation of ammunition during the logistical life-cycle. The solution must be low weight, space and cost-effective. The technology must also enhance the packaging configuration and possess a level of portability. That is, the device should be easily removed and reinstalled as required during shipping and handling operations prior to a fire mission.

SUMMARY OF THE INVENTION

It is an object of the invention to provide an apparatus and method to mitigate SD of high explosive ammunition that is portable and provides protection during the complete logistical life-cycle of the ammunition.

One aspect of the invention is a sympathetic detonation barrier for a munition comprising a generally cylindrical polyethylene sleeve disposed over the munition. Preferably, the sleeve comprises HDPE. The sleeve may include vent openings in a side wall.

In one embodiment, the sleeve extends from substantially a rear end of the munition to substantially a rear end of a fuze well of the munition. The sleeve may cover the rotating band of the munition.

In some embodiments, the sleeve comprises a large inside diameter portion and a small inside diameter portion wherein the large inside diameter portion is adjacent the rotating band of the munition. The barrier may include means for securing a top portion of the sleeve to the munition.

Another aspect of the invention is an apparatus comprising a munition having a rear end, a fuze well including a rear end, and a rotating band; and a sympathetic detonation barrier placed over the munition, the sympathetic detonation barrier comprising a generally cylindrical polyethylene sleeve. The sleeve may comprise HDPE.

Yet another aspect of the invention is an apparatus comprising a pallet bottom having a plurality of recessed openings therein; a plurality of munitions having rear ends placed in the recessed openings in the pallet bottom; a plurality of generally cylindrical HDPE sleeves placed over the munitions; and a pallet top having a plurality of openings therein wherein tops of the munitions are placed in the openings in the pallet top.

Still another aspect of the invention is a method of preventing sympathetic detonation of munitions comprising at least partially enclosing each munition in a generally cylindrical HDPE sleeve.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

The invention mitigates or eliminates the problem of sympathetic detonation (SD) in large caliber high explosive packaged artillery ammunition. The invention may be applied to other types of ammunition as well (such as missiles, mines, mortars, grenades, etc). The invention includes a generally cylindrical sleeve that is placed over high-energy munitions. The sleeve is preferably made of high-density polyethylene (HDPE). The sleeve is of a thickness sufficient to prevent neighboring high-energy munitions from SD. Thus, a high order explosive event in one ammunition round will not propagate to neighboring ammunition rounds. The invention will also mitigate and/or prevent the loss of life and subsequent collateral damage.

Figure 1:
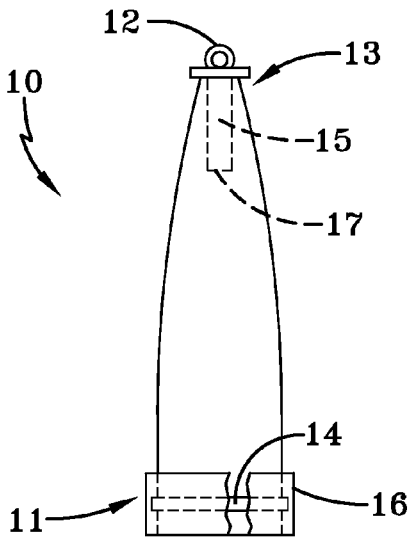
FIG-1 PRIOR ART
FIG. 1 is a side view of an artillery projectile.

FIG. 1 is a side view of a munition 10. The munition 10 shown is an artillery projectile, but the invention is applicable to other types of munitions, also. Munition 10 includes a rear end 11, a front end 13, a lifting plug 12 at the front end 13, a fuze well 15 (dashed lines) having a rear end 17, a rotating band 14 (dashed lines) disposed near the rear end 11 and, optionally, a flexible cover 16 to cover and protect the rotating band 14. The flexible cover 16 is typically secured around the rotating band 14 with a hook and loop fastener or, it may simply be placed over the band 14 in a free-floating manner.

Figure 2:
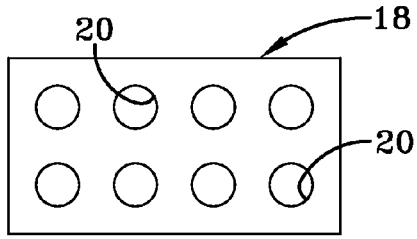
FIG-2 PRIOR ART
FIG. 2 is a top view of a pallet bottom.
Figure 3:
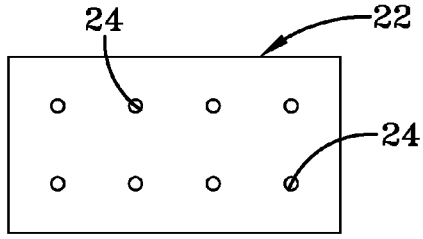
FIG-3 PRIOR ART
FIG. 3 is a top view of a pallet lid.

FIG. 2 is a top view of a metal pallet bottom 18 used for storing and shipping munitions 10. Munitions 10 stand upright on pallet bottom 18 with the rear ends 11 of the munitions 10 disposed in the recessed openings 20 in the pallet bottom 18. In the pallet bottom 18 shown in FIG. 2, eight recessed openings 20 are provided for eight munitions, however, other numbers of openings 20 may be provided. FIG. 3 shows a pallet top 22 having openings 24 therein. The lifting plugs 12 of the upright munitions 10 fit through openings 24. The pallet bottom 18 and pallet top 22 are then strapped together using, for example, metal bands. Not only are the munitions 10 adjacent each other on the pallet 18, 22, but several pallets are typically placed side by side. The pallet top and bottom 22, 18 may be made of, for example, metal, wood, plastics, composites, etc.

Figure 4A:
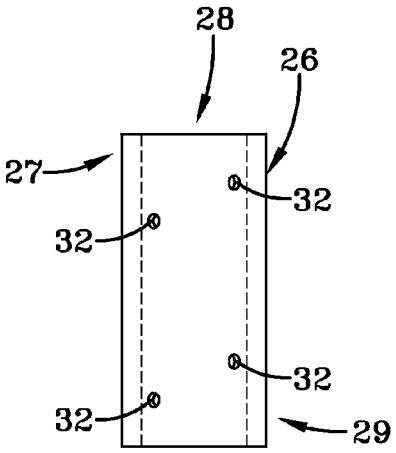
FIGS. 4A and 4B are side and end views, respectively, of a sleeve.
Figure 4B:
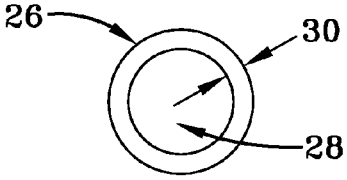

FIG. 4A is a side view and FIG. 4B is an end view of a sympathetic detonation barrier in the form of a generally cylindrical sleeve 26 having a central opening 28 therethrough, a front end 27 and a rear end 29. Sleeves 26 are placed over each munition 10. Sleeve 26 comprises polyethylene, preferably high-density polyethylene (HDPE). Sleeve 26 has a thickness 30 sufficient to prevent sympathetic detonation of munitions 10 stacked in pallets 18, 22.

Sleeve 26 may be provided with one or more vent holes 32 formed in its side wall. The vent holes 32 help mitigate corrosion of munition 10 by allowing some air circulation. The HDPE sleeve 26 is inexpensive, light-weight, robust and provides for increased protection from environmental influences, including physical abrasion and thermal loading from solar radiation. HDPE sleeve 26 is highly resistant to chemical and biological elements, and easily decontaminated. Used sleeves 26 may be recycled. Sleeves 26 produce minimal logistical impact when considered relative to the destructive results of mass detonation of stored, unprotected munitions 10.

Figure 5:
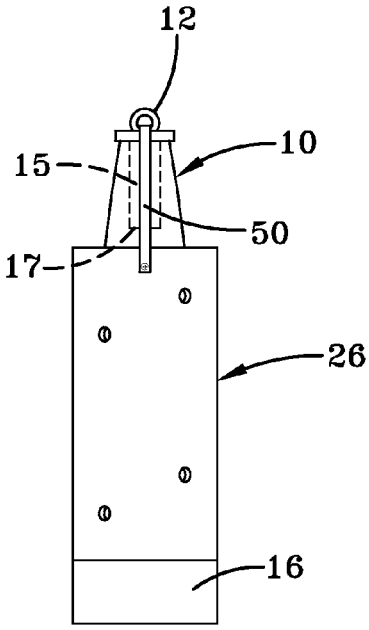
FIG. 5 is a side view of a sleeve on a projectile.

The length of the sleeve 26 may vary from munition to munition. FIG. 5 is a side view of a sleeve 26 on a munition 10. Sleeve 26 extends substantially from the top of the rotating band cover 16 to the rear end 17 of the fuze well 15 of the munition 10. In this way, sleeve 26 surrounds the portion of munition 10 containing the high explosive. Optionally, sleeve 26 may be secured to munition 10 via a strap 50 (or other suitable means) that passes through lifting lug 12 and is attached on opposite sides of sleeve 26 using, for example, screws, rivets or other suitable means.

Figure 6:
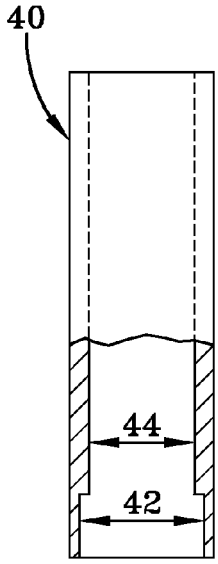
FIG. 6 is a side view of a sleeve, partially in section.

FIG. 6 is a side view of an alternate embodiment of a sleeve 40 with the lower portion shown in section. Sleeve 40 is similar to sleeve 26, except that sleeve 40 includes a large inside diameter portion 42 and a small inside diameter portion 44. When using sleeve 40, the rotating band cover 16 is not needed. Sleeve 40 extends from substantially the rear end 11 of the munition 10 to substantially the rear end 17 of the fuze well 15. Sleeve 40 covers the rotating band 14 with the large inside diameter portion 42 adjacent the rotating band 14 of the munition 10.

Figure 7B:
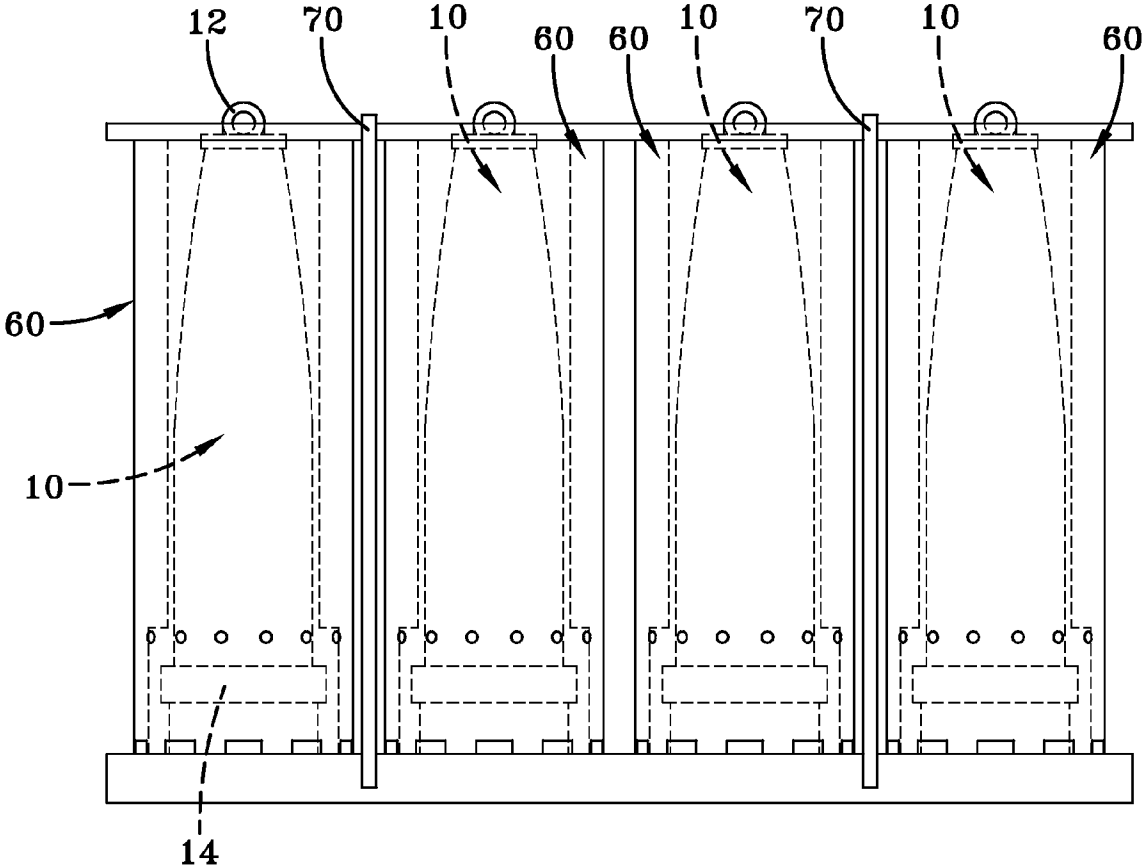
FIG. 7B is a side view of a plurality of projectiles on a pallet.
Figure 7A:
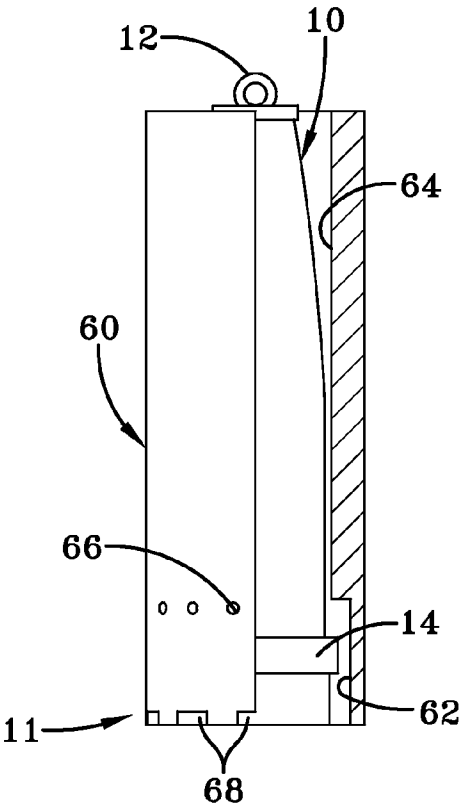
FIG. 7A is a side view of a sleeve and projectile with a portion of the sleeve cutaway to show the projectile inside.

FIG. 7A is a side view of another embodiment of a sleeve 60 placed over a projectile 10. In FIG. 7A, sleeve 60 is partially cutaway so that a portion of projectile 10 is visible. Sleeve 60 extends from the rear end 11 of projectile 10 to just below lifting plug 12. Sleeve 60 includes a large inside diameter portion 62 and a small inside diameter portion 64. When using sleeve 60, the rotating band cover for rotating band 14 is not needed. Sleeve 60 includes vent holes 66 located above rotating band 14 and vents 68 located below rotating band 14. Vent holes 66, 68 help prevent corrosion of the rotating band 14. FIG. 7B is a side view of a plurality of projectiles 10 having sleeves 60 and positioned between a pallet top and bottom 22, 18. Bands 70 are used to secure the pallet top and bottom.

Examples of munitions that may use the sympathetic barrier of the invention are the 155 mm M107 and M795 high explosive (HE) artillery projectiles. The M107 HE projectile is about 684 mm long (including the lifting plug) and requires an SD barrier or sleeve that completely surrounds the explosive fill of the projectile. An SD barrier sleeve for the 155 mm, M107 HE projectile is approximately 580 mm long and is about 9.53 mm thick. The M795 HE projectile is approximately 812.5 mm long (including the lifting plug) and requires a sleeve about 686 mm long and approximately 19.05 mm thick. In both examples, the barrier sleeve should fill the space between the upper and lower plates of the projectile pallets. This space is the exposed portion of the HE filled projectiles.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An apparatus consisting of:

a munition having a rear end, a fuze well including a rear end, and a rotating band; and a sympathetic detonation barrier placed over a portion of the munition, the sympathetic detonation barrier comprising a generally cylindrical high-density polyethylene sleeve, which sleeve extends from substantially the rear end of the munition to substantially the rear end of the fuze well of the munition, the sleeve not covering the portion of said munition housing a fuze.

2. The apparatus of claim 1 wherein the sleeve comprises a large inside diameter portion and a small inside diameter portion, the large inside diameter portion being adjacent the rotating band of the munition.

3. The apparatus of claim 1 wherein the sleeve extends from substantially the rotating band of the munition to a rear end of a fuze well of the munition.

4. The apparatus of claim 1 wherein the sleeve includes vent openings in a side wall.

* * * * *